US006055710A

United States Patent [19]

Fleissner

[11] Patent Number: 6,055,710

[45] Date of Patent: May 2, 2000

[54] DEVICE FOR HYDRODYNAMIC NEEDLING OF FLEECES, TISSUES, OR THE LIKE

[75] Inventor: Gerold Fleissner, Zug, Switzerland

[73] Assignee: Fleissner GmbH & Co. Maschinenfabrik, Egelsbach, Germany

[21] Appl. No.: 08/967,014

[22] Filed: Nov. 10, 1997

[30] Foreign Application Priority Data

| | | | |
|---|---|---|---|
| Nov. 11, 1996 | [DE] | Germany | 196 46 477 |
| Nov. 13, 1996 | [JP] | Japan | 196 46 948 |
| Dec. 5, 1996 | [DE] | Germany | 196 50 367 |

[51] Int. Cl.[7] ..... D04H 1/46

[52] U.S. Cl. ..... 28/104; 28/105; 28/167

[58] Field of Search ..... 28/104, 105, 106, 28/167, 163; 492/32, 33, 49, 50, 28; 428/116; 162/368, 372, 373

[56] References Cited

U.S. PATENT DOCUMENTS

| | | | |
|---|---|---|---|
| 3,485,706 | 12/1969 | Evans . | |
| 3,590,453 | 7/1971 | Bryand . | |
| 3,681,184 | 8/1972 | Kalwaites | 28/105 |
| 3,750,237 | 8/1973 | Kalwaites | 28/105 |
| 3,768,121 | 10/1973 | Kalawaites | 28/105 |
| 3,781,957 | 1/1974 | Luthi . | |
| 3,828,410 | 8/1974 | Zeiffer . | |
| 4,050,131 | 9/1977 | Bryand . | |
| 4,777,070 | 10/1988 | Huvey . | |
| 4,868,958 | 9/1989 | Suzuki et al. | 28/104 |
| 5,042,722 | 8/1991 | Randall, Jr. et al. | 28/105 |
| 5,115,544 | 5/1992 | Widen | 28/105 |
| 5,238,644 | 8/1993 | Boulanger et al. | 28/104 |
| 5,353,485 | 10/1994 | Billgren et al. | 28/104 |
| 5,575,080 | 11/1996 | Fleissner . | |
| 5,632,072 | 5/1997 | Simon et al. | 28/167 |
| 5,822,833 | 10/1998 | James et al. | 28/105 |

FOREIGN PATENT DOCUMENTS

| | | | |
|---|---|---|---|
| 0 223 614 | of 0000 | European Pat. Off. . | |
| 223614 | 5/1987 | European Pat. Off. . | |
| 2734285 | 11/1996 | France . | |
| 4422 508 | of 0000 | Germany . | |
| 15 10 359 | 7/1970 | Germany . | |
| 1510359 | 7/1970 | Germany . | |
| 40-4327255 | 11/1992 | Japan | 28/14 |
| 2123863 | 2/1984 | United Kingdom . | |

*Primary Examiner*—Amy B. Vanatta
*Attorney, Agent, or Firm*—Antonelli, Terry, Stout & Kraus, LLP

[57] ABSTRACT

The permeable drum for needling tissues, nonwovens, or other permeable materials of a certain width consists of a normally perforated sheet metal drum on which strips that are thin and extend axially over the length of the drum are arranged with small distances between them around the drum. The strips radially support a very thin sheet metal jacket with microfine perforations and produce a uniform flow of liquid through the material that rests externally against the sheet metal jacket. The strips can be joined together for example to form a honeycomb profile and thus uniformly transfer the hydrodynamic load developed during needling to the screen drum.

25 Claims, 1 Drawing Sheet

1
2
3
4
5
5'
6
7
8
10
11
12
13
14
II

DEVICE FOR HYDRODYNAMIC NEEDLING OF FLEECES, TISSUES, OR THE LIKE

BACKGROUND OF THE INVENTION

A device is known for hydrodynamic needling of fleeces, tissues, or paper with a liquid processing means sprayed from a plurality of nozzles against the material, said device consisting of a sheet metal drum associated with the nozzles and possibly subjected to an internal vacuum, said drum serving as a supporting element for the material, said means additionally being covered at its circumference by a covering that is permeable to liquid, with a support being provided between the liquid-permeable covering and the sheet metal drum to increase the distance between the drum and the covering.

A device of this kind is also known from DE-GM 1 886 883 for through-flow heat treatment of textiles. In this document, a screen fabric with a coarser wire diameter is proposed as the support. This additional drum covering has the advantage that the material resting on the perforated drum can be ventilated more uniformly than if the material is in direct contact with the perforated sheet metal drum. The material to be treated, because of the additional screen fabric, is located at a greater distance from the jacket surface of the drum so that no dead spots, i.e. areas through which there is no flow, do not occur on the surface of the material.

Another screen drum design is known from DR 39 05 736 A1. In this design, a perforated sheet is not used to make the drum, but sheet metal strips extending in the axial direction run instead between the two bottoms of the drum, with spacers located between the strips sheet metal strips and being held together by screws. This sheet-metal-strip spacer design makes the drum stable without using the sheet metal of the drum as a screen. It is therefore optimally permeable to air, but costly to manufacture.

Finally, reference can be made to DE 44 22 508 C1 according to which sheet metal strips that extend axially in a straight line for the entire length of the drum and serve as a support are distributed in multiples around the circumference of the drum. The strips are made rectangular or round and must be welded to the drum. This fastening, however, causes the sheet metal of the drum to warp. In addition, the covering in that document consists of a screen fabric in which individual fibers can become trapped, resulting in contamination that is difficult to remove.

In the field of water needling, in other words hydrodynamic interlacing of the fibers of a material such as tissue or the like that is moved beneath the streams from the jets to compact it, U.S. Pat. No. 3,485,706 could be cited. Basically, the use of finely perforated sheet metal as a coating on a permeable drum is known from this patent. With such smooth, finely perforated sheet metal that replaces fabric made of woven wires, smoother compacted fleeces are produced by water needling, since the smooth sheet metal has a sort of ironing effect while nevertheless serving because of its permeability to carry away the water sprayed on it. However, it is difficult to control clogging of the fine holes in the sheet metal that carry away the liquid, said holes readily becoming clogged with fibers of the fleece or with deposits of the liquid that is sprayed. In this connection, EP 0 223 614 B2 could be mentioned. Here again, the covering consists of finely perforated cylindrical sheet metal. The drum design that supports the sheet metal in that patent consists of a perforated cylinder with ribs aligned axially lengthwise that are located between the rows of holes and project radially, each tapering to form a point. The manufacture of such a drum is very costly and tedious.

SUMMARY OF THE INVENTION

The goal of the invention is to design a screen drum design for water needling such that uniform finely distributed permeability of the drum to water is achieved and the drum can be manufactured economically, there being no danger of changing the cylindrical alignment of a thin drum covering. At the same time, assurance is also provided that the liquid sprayed on the drum will be carried away by the vacuum produced inside the drum, with no danger of air leaks in the marginal areas of the sealing lines of the suction device.

To achieve this goal, a device is provided according to the invention for the hydrodynamic compaction of fleeces, tissues, or paper, with a liquid processing means being sprayed against the material from a plurality of nozzles, said device consisting of a permeable sheet metal drum associated with the nozzles and provided internally with a vacuum, said drum serving as an intrinsically rigid supporting element for the material during water needling, said drum being covered on its circumference with liquid-permeable sheet metal designed as a thin sheet with microfine perforations, and with a support that is unstable by itself being located between the liquid-permeable sheet and the sheet metal drum, said support being composed of strips that simply serve to increase the distance between the sheet metal drum and the sheet, said strips being arranged with close and constant spacing uniformly over the entire circumference of the permeable sheet metal drum, with said permeable sheet metal drum directly abutting the edges of the strips located radially inward and the liquid-permeable sheet at the radially outer edges of the strips.

An important advantage of the design of this water needling drum with the design according to the invention is the good liquid permeability that remains constant even during use over a prolonged period of time, even in a drum that has a smooth surface resembling a cylinder. Because of the thin spacing strips that are thin in cross section, little or no resistance opposes the fluid streams striking from the nozzles. The dense arrangement of the strips with respect to one another means that the thin sheet metal jacket remains cylindrical while sufficient space is nevertheless provided between the strips so that any fibers that come loose from the fleece web cannot clog the drum or can do so only very slowly, reducing its permeability. There is no risk of the fibers being trapped in a woven wire structure like that formerly used for spacing. In addition, it is now possible to provide a straight-line seal at the inside of the drum to draw off the liquid sprayed onto it, because now no air can be sucked in from the lateral areas through the wires of a fabric for example.

This design of the drum is especially suitable as a supporting drum for water needling of nonwovens, with a smooth surface on the needled fleece being produced by the finely perforated cylindrical jacket. However, the jacket can also consist of a sheet metal structure that is specially structured radially externally, depending on the surface of the fleece to be obtained after water needling.

The strips are located very close together, with only 3 mm between them for example. At the same time, the strips are very thin, for example 1–2 mm in cross section. Accordingly, the strips then have a length of only 4 to 6 mm. Of course, not only are other measures possible within this framework and included in the scope of protection, but these strips also have a limited height of 3–5 mm for example. The sole reason for this is the spacing of the sheet metal with microfine perforations. In order to maintain this distance, the strips are connected together. It is advantageous for a number of such strips to form a lengthwise strip that extends over the entire length of the drum or in the circumferential direction around the drum. The lengthwise strip is then formed in a wavy or zigzag shape so that areas are formed that contact one another in the case of strips that are side by side. At these areas, the plurality of lengthwise strips is connected together by gluing or welding for example. This produces a honeycomb structure for example, with very fine and short strips.

The support can also be formed from strips that are aligned only axially or even from strips that are used alone or in combination with strips that extend radially. The design must be selected depending on the individual application.

BRIEF DESCRIPTION OF THE DRAWINGS

The drawing shows an embodiment of the device according to the invention.

DETAILED DESCRIPTION OF THE PREFERRED EMBODIMENTS

Figures 1, 2, 3, 4, 5:
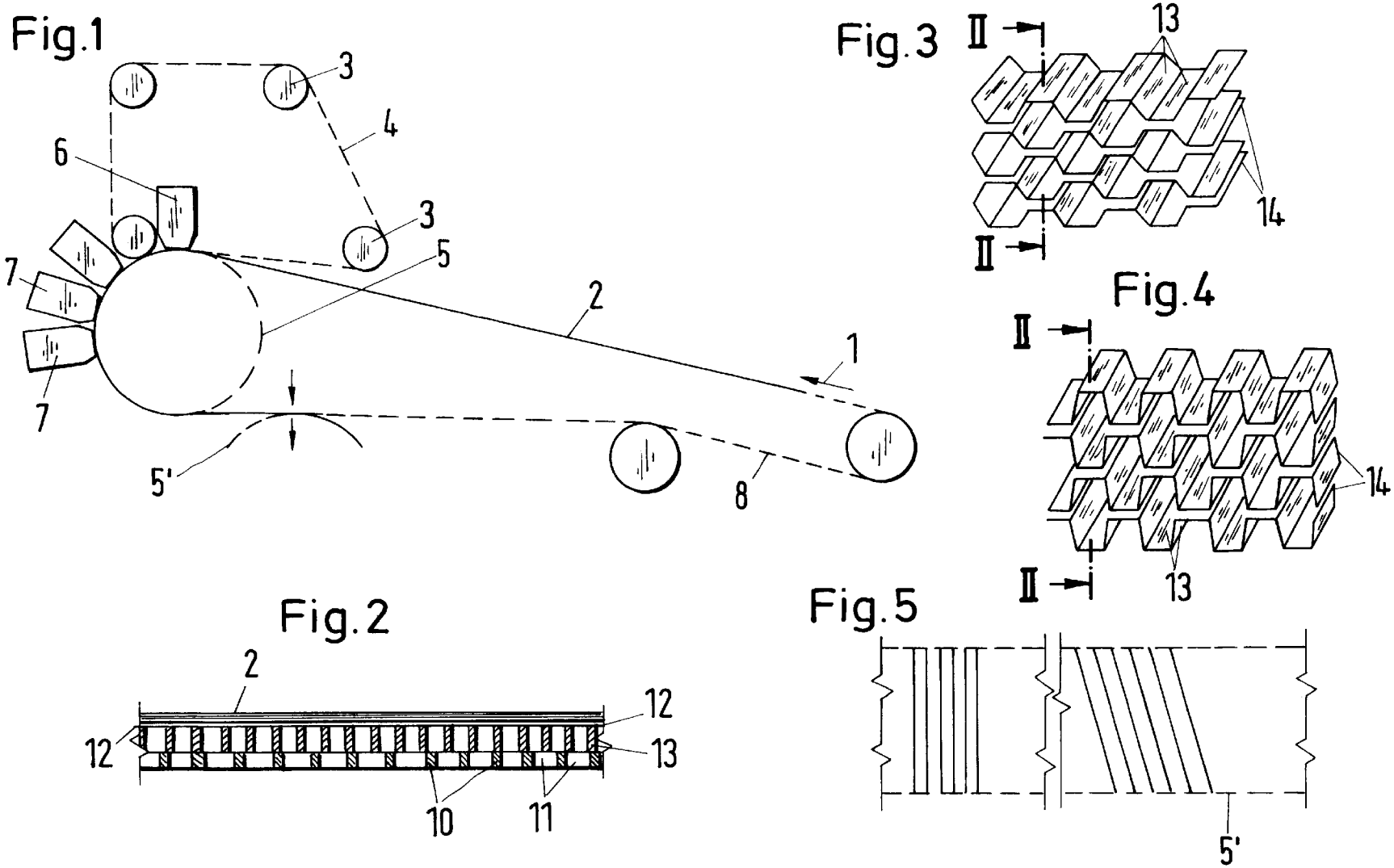
FIG. 1 is a side view of the inlet of a multistage water needling device with a nozzle beam that is associated only with the first needling drum.
FIG. 2 shows an enlarged view of the sheet metal jacket of one of the needling drums in the same cross-sectional view, with the support, for example, a section II-II being indicated as in FIG. 3.
FIG. 3 is a perspective view of the support as a honeycomb profile between the radially inner screen drum and the radially outer sheet metal jacket.
FIG. 4 likewise is a perspective view of another profile of this support.
FIG. 5 is a top view of a needling drum with the strips of the support running radially or helically.

Looking in the direction of arrow 1, the fiber web 2 coming from a carding machine, not shown, runs onto endless belt 8, tensioned by deflecting rolls. At the end of the upper run, one of the two deflecting rolls is designed as so-called take-up roll 5 which is not only located at a tangent to compacting endless belt 4 located above it but dips into the plane of endless belt 4 that is guided under tension by means of deflecting roll 3. This ensures a reliable transfer of the fiber web to take-up roll 5. Prior to the transfer, fiber web 2 is merely wetted through endless belt 4 by means of nozzle beam 6 associated with endless belt 4.

The first needling then takes place on take-up roll 5, in this case using three nozzle beams 7. Endless belt 8 that wraps around take-up roll 5 also transports needled fleece 2 from take-up roll 5 to the next roll 5', which likewise has nozzle beam 7 associated with it but not shown here. Take-up roll 5 is designed to be liquid-permeable as indicated by the dashed line in FIG. 1. The liquid sprayed through nozzle beams 6 and 7 onto the fleece is blown through rolls 5 and 5' and carried away from the interior by the vacuum generated there.

Each of needling rolls 5, 5' is designed as a sheet metal drum. These drums consist of a sheet 10 bent into a cylinder and forming the supporting structure, said sheet being provided with perforations 11 uniformly distributed over the entire surface. Above sheet metal drum 10, located radially externally, is a sheet 12 with microfine perforations on which fleece 2 rests during needling. In order for the permeability of fine sheet 12 not to be significantly impeded by the impermeable ribs between the holes in sheet metal drum 10, strips 13 serve to distance sheet 12 away from sheet metal drum 10, said strips being less than 2 mm in cross section and extending axially and radially around drum 10. Strips 13 are spaced so closely together, only 1 to 10 mm for example, and preferably 2 to 4 mm, that sheet metal jacket 12 with its thin cross section cannot bend as a covering between strips 13.

A system for needling a fleece usually consists of a plurality of drums 5, 5' etc. with the fleece being subjected to streams of water on alternating sides. Since, in the embodiment shown in FIG. 1, drum 10 is wrapped by endless belt 8 to supply the fleece, the design with sheet 12 with microfine perforations and support 13 according to the invention should be located on drum 5', etc.

The strip structure of drum 5' therefore consists of radially directed strips 13 whose radially aligned height can be seen in FIGS. 2 to 4. Strips 13 can also have a different cross section. They can be designed so that they are round or taper to a point at their radially outer circumference, in order to offer as little resistance as possible to the streams of water. Therefore sheet metal jacket 12 with microfine perforations that forms a screen rests only on the radially outer edges of strips 13. Strips 13 have their radially inner edges resting directly on sheet metal drum 10 and are arranged with a specific short distance side by side between them on sheet metal drum 10. In order for this distance and the precise alignment of strips 13 to be fixed over the width of the drum, the strips that are shown only in section in FIG. 2 are connected with one another in the axial direction and in the circumferential direction of the drum. Thus, the strips as shown in FIG. 2 each consist of two strips that are parallel to one another and are glued or otherwise joined. An example is shown in FIG. 3 or FIG. 4, see sections II—II. For example, screen drum 10 must be imagined with its holes 11 at the rear surface of the profile, which is not visible, while the forward surface of the profile in the drawing has finely perforated sheet 12 resting on it. The individual strips 13 are joined together to form a lengthwise strip 14, with lengthwise strip 14 consisting of a plurality of such strips 13. To make them, a long narrow strip of a thin plastic or rolled sheet is bent into a sinusoidal shape or compressed and then the adjacent surfaces of two such lengthwise strips 14 are glued or otherwise joined to form strips 13. This produces an unstable structure which is nevertheless very stable in the direction of the openings parallel to strips 13. Nothing more is required because the permeability of the honeycomb profile to liquid is maximal, i.e. 98%, and the stability in the radial direction is sufficient to accept the load imposed by the water streams directed against sheet 12 with its microfine perforations, and projection of screen drum ribs 10 is avoided.

Honeycomb profiles are shown in FIGS. 3 and 4. Ribs 13 however can also be joined together to form a rectangle. This is only a matter of manufacturing. When using a strip construction with rectangles, it is only necessary to make sure that the strips do not run in the axial direction but at an angle of less than 90° so that no line parallel to the alignment of nozzle beam 7 is formed on the tissue.

In order for the permeability of covering 12 not to be significantly restricted by the supporting structure of sheet metal drum 10, in the embodiment according to FIG. 5 sheet metal strips 13 are used to space the covering away from sheet metal drum 10, said strips extending not only radially but also possibly being wrapped like rings around sheet metal drum 10 in the circumferential direction around drum 10. Sheet metal strips 13 are located short distances apart, so close to one another that sheet metal jacket 12 which is thin in cross section cannot bend as a covering between sheet metal strips 13. The strips that run radially are shown at the left in FIG. 5. It is equally advisable to wrap sheet metal strips 13, rather than exactly radially, helically over the entire axial length of the drum as shown on the right side of FIG. 5.

The material of the support can be made of plastic such as aramid, or from aluminum. In the case of aluminum, it is advantageous to chrome-plate the profile.

I claim:

1. Device for hydrodynamic solidification of fleeces, tissues, or paper, or needling of fabrics or wovens with a liquid processing means sprayed by a plurality of nozzles, said device comprising a sheet metal drum associated with said nozzles, said drum being permeable and serving as a rigid supporting element for material during water needling, said drum being covered at its circumference by a liquid-permeable thin sheet with microfine perforations, and with a support which is unstable in itself and made of strips being provided between the liquid-permeable sheet and the sheet metal drum, for the sole purpose of increasing the distance between the sheet metal drum and the liquid permeable sheet, with the strips being arranged with small constant distances between them uniformly over the entire circumference of the sheet metal drum, and with the sheet metal drum directly abutting radially inner edges of strips and with the liquid-permeable sheet directly abutting radially outer edges of the strips.

2. Device according to claim 1, characterized in that the support is formed of strips that run only axially.

3. Device according to claim 1, characterized in that the support is formed only of strips that extend radially.

4. Device according to claims 1, characterized in that the strips are made rectangular in cross section and have a thickness of less than 2 mm.

5. Device according to claim 1, characterized in that the strips are made rectangular in cross section.

6. Device according to claims 1, characterized in that the strips are arranged a distance of 1 to 10 mm.

7. Device according to claim 1, characterized in that the strips are made round in cross section at their radially outer edges.

8. Device according to one of claim 1, characterized in that the strips are made such that they taper to a point in cross section at their radially outer edges.

9. Device according to one of claim 1, characterized in that the strips are made of plastic.

10. Device according to one of claim 1, characterized in that the strips are made of chrome-plated aluminum.

11. Device according to, characterized in that the strips have a length of 1 to 10 mm and are connected at their ends with adjacent strips.

12. Device according to claim 1, characterized in that the lengthwise strips are formed over the length or over the circumference of the drum from the strips, said lengthwise strips being shaped in the form of waves or areas that extend in straight lines in a zig-zag fashion, and the contact surfaces of the lengthwise strips located next to one another are joined to one another to form a perforated structure.

13. Device according to claim 12, characterized in that the strips are connected to form the lengthwise strips at an angle of greater than 90°, in a honeycomb fashion.

14. Device according to claim 12, characterized in that the strips are joined together at right angles to form the lengthwise strips.

15. Device according to claim 14, characterized in that the strips run at an angle of less than 90° and diagonally to the axis of the sheet metal drum.

16. Device according to claim 12, characterized in that the lengthwise strips are made in one piece with the strips aligned to form angles with one another.

17. Device according to claim 12, characterized in that the lengthwise strips are glued together to form the perforated structure.

18. Device according to claim 15, characterized in that the lengthwise strips are glued together at points to make the perforated structure.

19. Device according to claim 12, characterized in that the lengthwise strips are soldered or welded together spotwise to make the perforated structure.

20. Device according to claim 1, characterized in that the liquid-permeable sheet is made from a printing-jacket sheet with microfine perforations.

21. Device according to claim 20, characterized in that the liquid permeable sheet is made of nickel and the perforations consist of holes measuring 0.1 to 2 mm in size.

22. Device according to claim 1, characterized in that the radially inner edges of the strips are glued to the outer circumference of the sheet metal drum for a permanent connection.

23. Device according to one of claim 1, characterized in that the strips are made of sheet metal and the radially inner edges of the strips are shrunk onto the outer circumference of the sheet metal drum for a permanent connection.

24. Device according to claim 1, characterized in that the strips are made rectangular in cross section and have a thickness less than 1 mm.

25. Device according to claim 1, characterized in that the strips are arranged a distance of 2 to 3 mm apart.

* * * * *